US011540613B2

(12) United States Patent
Laaly

(10) Patent No.: US 11,540,613 B2
(45) **Date of Patent: *Jan. 3, 2023**

(54) NAIL PEN NIB

(71) Applicant: Noushin Laaly, Los Angeles, CA (US)

(72) Inventor: Noushin Laaly, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/349,119

(22) Filed: Jun. 16, 2021

(65) Prior Publication Data

US 2021/0307486 A1 Oct. 7, 2021

Related U.S. Application Data

(63) Continuation of application No. 16/392,530, filed on Apr. 23, 2019, now Pat. No. 11,058,205, which is a continuation of application No. 15/360,651, filed on Nov. 23, 2016, now Pat. No. 10,306,969.

(60) Provisional application No. 62/260,222, filed on Nov. 25, 2015.

(51) Int. Cl.

| | |
|---|---|
| ***A45D 34/04*** | (2006.01) |
| ***A45D 29/00*** | (2006.01) |
| ***B43K 8/02*** | (2006.01) |
| ***B43K 8/04*** | (2006.01) |

(52) U.S. Cl.

CPC ..... *A45D 34/042* (2013.01); *A45D 29/00* (2013.01); *B43K 8/022* (2013.01); *B43K 8/04* (2013.01); *A45D 2029/002* (2013.01)

(58) Field of Classification Search

CPC ..... A45D 2029/002; B43K 1/006; B43K 1/12
USPC ..... 401/193, 206
See application file for complete search history.

(56) References Cited

U.S. PATENT DOCUMENTS 807,887 A * 12/1905 Walker ..... B43M 11/00 15/210.1
1,611,937 A * 12/1926 Nelson ..... A45D 40/02 401/98
2,065,298 A * 12/1936 Abbott ..... B05C 17/00516 401/266
2,242,016 A * 5/1941 Mckinney, Jr. ..... A45D 34/045 132/73
2,537,468 A * 1/1951 Lanius, Jr. ..... A45D 40/265 132/73
3,830,573 A * 8/1974 Schwartzman ..... B43K 5/1845 401/206
4,208,145 A * 6/1980 Azuma ..... B43K 1/003 401/265

(Continued)

FOREIGN PATENT DOCUMENTS

EP 0254240 A2 * 1/1988

*Primary Examiner* — David P Angwin
*Assistant Examiner* — Bradley S Oliver
(74) *Attorney, Agent, or Firm* — Payam Moradian

(57) ABSTRACT

Provided is an assembly for a nail pen comprising: a) a nib made from a material that is configured to allow for movement of varnish from inside of the nail pen to the nib, and from the nib to a nail; b) a guide made from a material that is non-absorbent to the varnish, the guide extending below a surface of the nib that is configured to apply varnish to the nail; wherein a user applies a strip of the varnish to a distal portion of the nail by holding the guide against an edge of the nail and moving the nail pen along the distal portion of the nail so that the surface of the nib holding the varnish contacts the distal portion of the nail to apply varnish to the nail.

19 Claims, 13 Drawing Sheets

(56) References Cited

U.S. PATENT DOCUMENTS

| | | | | |
|---|---|---|---|---|
| 4,453,849 | A * | 6/1984 | Fernandez | B43K 23/00 401/196 |
| 4,666,709 | A * | 5/1987 | Jankewitz | A61Q 3/02 424/61 |
| 4,848,947 | A * | 7/1989 | Kremer | A46B 11/0013 401/206 |
| 4,944,318 | A * | 7/1990 | Gaylord, Jr | A45D 34/045 132/73 |
| 5,044,803 | A * | 9/1991 | Kurosawa | B05C 17/00516 401/265 |
| 6,035,859 | A * | 3/2000 | Antonopoulos-McIvor | A45D 34/042 132/74.5 |
| 6,641,320 | B1 * | 11/2003 | Ballot | B43K 5/1845 401/206 |
| 8,662,089 | B2 * | 3/2014 | Hwang | A45D 29/11 401/35 |
| 8,721,212 | B2 * | 5/2014 | Chou | A46B 11/0079 401/276 |
| 9,908,362 | B2 * | 3/2018 | Yasumi | B43K 8/08 |
| 10,306,969 | B1 * | 6/2019 | Laaly | A45D 29/00 |
| 2008/0145136 | A1 * | 6/2008 | Korper | B43K 8/04 401/206 |
| 2012/0087708 | A1 * | 4/2012 | Campbell | B43K 8/024 401/11 |
| 2014/0360525 | A1 * | 12/2014 | Uehara | A45D 29/004 132/285 |
| 2016/0143415 | A1 * | 5/2016 | Laaly | A45D 34/042 401/193 |

* cited by examiner

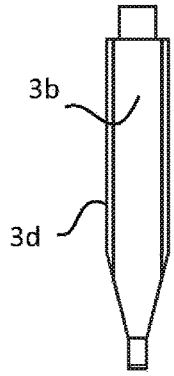
FIG. 10
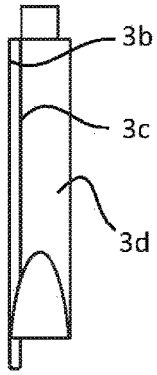
FIG. 10a
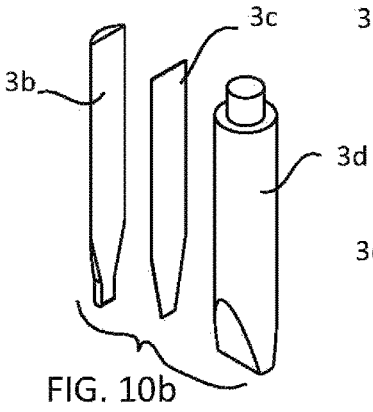
FIG. 10b
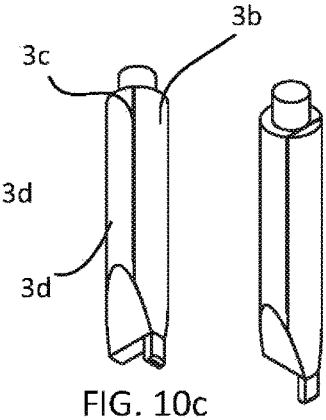
FIG. 10c
FIG. 10d
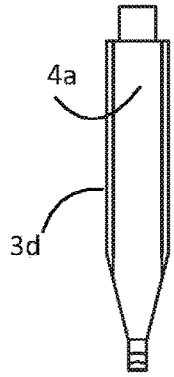
FIG. 11
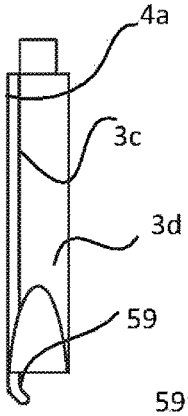
FIG. 11a
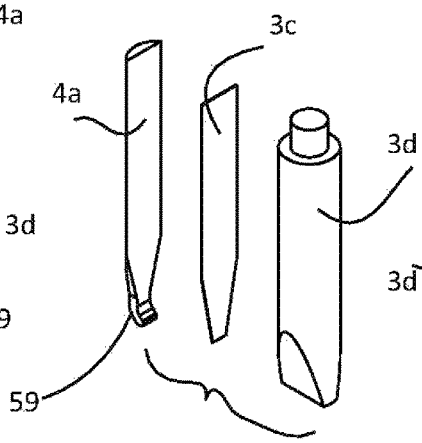
FIG. 11b
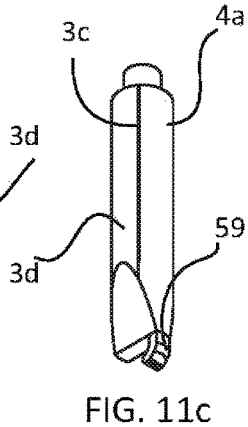
FIG. 11c
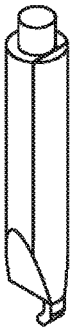
FIG. 11d
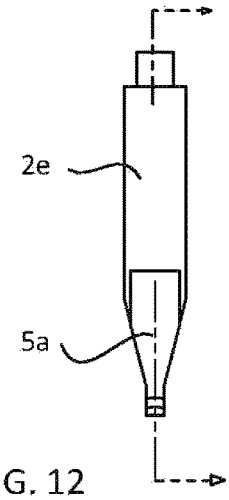
FIG. 12
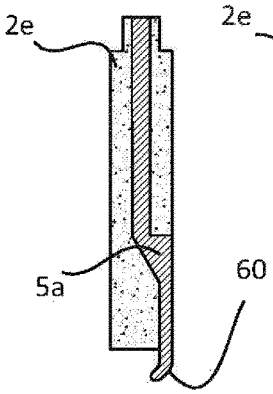
FIG. 12a
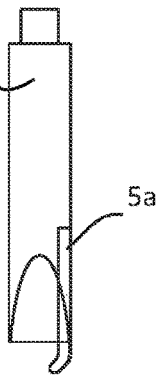
FIG. 12b
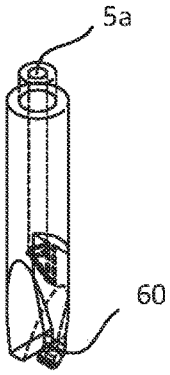
FIG. 12c
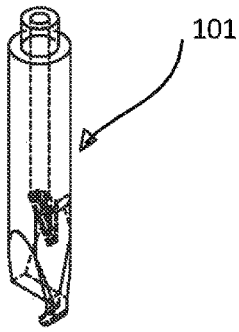
FIG. 12d

NAIL PEN NIB

CROSS-REFERENCE

The present application is a continuation of U.S. application Ser. No. 15/360,651, which claims the benefit of U.S. provisional patent appl. No. 62/260,222, filed on Nov. 25, 2015, which are incorporated herein by reference in their entirety.

BACKGROUND SECTION OF THE INVENTION

A beautician-assisted or self-administered French manicure procedure may involve the application of varnish, or similar type of nail polish substance, exclusively along a uniform and dimensionally-consistent distal-most region of a nail. It is possible for the nail varnish to be spread unevenly onto the distal perimeter of a nail due to the shaking of the hand of the individual applying the nail varnish. Due to the fast-hardening chemical characteristics of nail varnish, any imperfections or inconsistencies with the distribution of nail varnish on the distal perimeter of the nail will become bound to the nail surface. The correction of any minor imperfection or inconsistency with the distribution of nail varnish would not be able to be fixed without the removal of any or all of the nail varnish applied to that distal outer perimeter. There is a need in the art for applying a French manicure without these drawbacks.

SUMMARY SECTION OF THE INVENTION

Provided is an assembly of a nail pen nib and a nail pen guide. The assembly can beta single unit with a nail guide and a nib (applicator), the guide configured to contact with the edge of the nail tip and move along the edge of the nail tip so that varnish is applied from the nib (applicator) through the material of the nib (applicator) (particularly the bottom surface of the applicator) to only the distal portion of the nail (tip) to obtain a uniform strip of varnish, e.g., French manicure. The thickness of the French manicure can be from about 1 mm to about 10 mm (1 cm), such as about 2 mm to about 7 mm.

The guide and the nib (applicator) can be made as a single unit assembly. The guide can be made from a hard material that can be pressed against the edge of the nail tip such metal (stainless steel), non-metal, synthetic, polymer, plastic, and/or Ultem resin. The guide can be non-absorbent and non-permeable so not to absorb the varnish and minimize smearing on the finger tip and surrounding.

The portion of the guide that is exposed can have a Teflon (Polytetrafluoroethylene) coating. The nib (applicator) can be made from a material that allows the varnish to move from one end of the nib (applicator) in fluid communication with a source of varnish to the other end of the applicator configured to deliver varnish to the distal portion of the finger tip. Varnish can move through the nib (applicator) such as by diffusion and/or gravitation force or other force. The applicator can have substantially parallel fibers (or other non-parallel configurations) that are oriented from one end of the applicator to another end of the applicator. The applicator can be made from an absorbent material and/or a material with a high number of pores.

The nib (applicator) and the guide can be made into a single unit assembly. The unit assembly can be made from molding together nib (applicator) part(s) and guide part(s). The assembly can have a body with a uniform diameter comprised of both the nib (applicator) and the guide. The guide extends out of the bottom of the nib so to contact the edge of the nail tip. The assembly unit can be made by molding the guide and the nib (applicator) together. In one embodiment, adhesive may or may not be used to make unit. The adhesive can be gel-type to avoid absorption by the nib. The guide and the nib (applicator) can together run along (the guide can run through at the center) the body of the unit and can together be exposed at the top of the unit. The body of the nib can have a step, which is a reduction in diameter of the body. The top of the assembly can be received by a receiver (such as in the shape of a cup), so that when a user presses down the nib (for example on a nail, or a table), a force is applied to the receiver, opening a valve for receiving varnish from the barrel of the nail pen. By having the guide run across the entire unit and touch the receiver, the guide remains in a stable position in the nib unit. Alternatively, the guide is stabilized by a step in the nib adhesives, and/or other methods.

The guide can have a guide body, a member (such as a cylindrical rod) for contacting with the receiver in the nail pen, and a connector for connecting the member to the guide body. The guide can be fabricated from one piece material, and having these parts be incorporated into a single piece.

Alternatively, the guide can be made so it only has a guide body with no other member and makes no contact with a receiver in the nail pen. The member of the guide contacting the receiver can be coaxial with the applicator, and can form the center of the cylindrical assembly unit, with the nib (applicator) surrounding the member, which may itself be a cylinder. The nail guide can be inside the applicator in the nib in the middle and top of the nib, and then move to the periphery at the bottom of the nib and be exposed on the outside of the body.

Provided is an assembly for a nail pen comprising: a) a nib made from a material that is configured to allow for movement of varnish from inside of the nail pen to the nib, and from the nib to a surface of a nail; b) a guide made from a material that is non-absorbent to the varnish, the guide extending below a surface of the nib that is configured to apply varnish to the nail; wherein a user applies a strip of the varnish to a distal portion of the nail by holding the guide against an edge of the nail and moving the nail pen along the distal portion of the nail so that the surface of the nib holding the varnish contacts the distal portion of the nail to apply varnish to the nail; wherein the nib and, the guide are in an assembly. The assembly can be configured to be removable from the nail pen. The assembly can be cylindrical shaped. The guide can be configured as a sleeve to be placed on an outside portion of the nib. The nib can have an upper portion with a larger diameter than a lower portion with a smaller diameter, and the guide is placed on the lower portion of the nib with the smaller diameter. The sleeve and the nib can form a uniform surface. The top of the guide can be exposed on a top surface of the nib that is configured to be placed inside of the nail pen. The nib can be made from a single fabricated piece of the absorbent material, the nib having a channel inside at least along its top one fifth portion. The guide can be configured to be on outside of the nib in an end of the nib configured to contact the nail, and the guide is configured to be inside of the nib in an end of the nib configured to contact a component of the nail pen. The guide can be configured to be placed in a groove that is, on an outer surface of the nib. The guide and the nib can be coaxial at least in the top half end of the nib configured to contact the nail pen. The guide and the nib can be coaxial with the guide running along a central axis of the nib, the guide further extending outside of an end of the nib. The guide after coming out from a bottom of the nib, can expand in dimension in a perpendicular direction. A portion of the guide outside of the nib is larger in perpendicular direction that the portion of the guide inside of the nib. The assembly can be configured to be placed in a cavity at a bottom end of the nail pen. The nib and/or the guide can have a step. The nib and the guide can be stabilized in the assembly with one or more rings. In one embodiment, the nib and the guide are not coaxial. The nib and the guide can be coaxial. In one embodiment, the guide is not attached directly to the nail pen.

Provided is an assembly for attaching to a nail pen holding varnish comprising: a) a nib made from a material that is configured to allow for movement of varnish from inside of the nail pen to the nib, and from the nib to the nail, the nib further configured to make contact with a mechanism in the nail pen that is configured to allow for flow of varnish to the nib when the nib is pressed against the nail; b) a guide made from a material that is non-absorbent to varnish, the guide extending below a surface of the nib that is configured to apply varnish to the nail; wherein a user applies the varnish to a distal portion of the nail by holding the guide against an edge of the nail and moving the nail pen along the distal portion of the nail so that the surface of the nib holding varnish contacts the distal portion of the nail. Both the guide and the nib can make contact with the mechanism. Provided is a nail pen comprising: a) a nib made from a material that is configured to allow for movement of varnish from inside of the nail pen to the nib, and from the nib to a nail; b) a guide made from a material that is non-absorbent to varnish, the guide extending below a surface of the nib that is configured for applying varnish to the nail; c) a push button mechanism that is configured to allow for flow of varnish to the nib when the button is pressed by a user; and wherein a user applies the varnish to a distal portion of the nail by holding the guide against an edge of the nail and moving the nail pen along the distal portion of the nail so that the surface of the nib holding varnish contacts the distal portion of the nail; and wherein the nib and the guide are in an assembly. Provided is a nail pen comprising: a) a nail pen housing inside of which is a reservoir for varnish; b) a valve to stop flow of varnish; c) a mechanism configured to be actuated by a user to open the valve and allow varnish to flow to other side of the valve; d) a nib made from a material that is configured to allow for movement of varnish from inside of the nail pen after the valve and to the nib, and from the nib to a nail; and e) a guide that is non-absorbent to the varnish, the guide extending below a surface of the nib that is configured to apply varnish to the nail; wherein a user applies a strip of the varnish to a distal portion of the nail by holding the guide against an edge of the nail and moving the nail pen along the distal portion of the nail so that the surface of the nib holding the varnish contacts the distal portion of the nail to apply varnish to the nail; wherein the nib and the guide are in an assembly.

Provided is a nail pen comprising: a) a nib made from a material that is configured to allow for movement of varnish from inside of the nail pen after the valve and to the nib, and from the nib to a nail; and b) a guide that is made from a material that is not absorbent to the varnish, the guide extending below a surface of the nib that is configured for applying varnish to the nail; c) a nail pen housing inside of which is a reservoir for varnish, the nail pen having a cavity at one end configured to receive the nib; wherein a user applies a strip of the varnish to a distal portion of the nail by holding the guide against an edge of the nail and moving the nail pen along the distal portion of the nail so that the surface of the nib holding the varnish contacts the distal portion of the nail to apply varnish to the nail. A portion of the nib-guide assembly that can be placed inside of the cavity is cylindrical in shape. Both the guide and the nib can go inside of the cavity. Only the nib can go inside of the cavity. A mechanism can be configured to be actuated by a user to open the valve and, allow varnish to flow to other side of the valve. Provided is a method of applying a band of varnish to a distal portion of a nail comprising: a) placing a nib-guide assembly that is cylindrical in shape in an opening of a nail pen, wherein the guide is non-absorbent to varnish and the nib is absorbent, the guide further extending below a lowest surface of the nib; b) placing the guide of the nail pen against the edge of the nail; c) placing the nib against the nail; and d) moving the nib on the distal portion of the nail to apply varnish to the nail.

Provided is a nib for a nail pen comprising a cylindrical body configured to allow for movement of varnish from proximity to a top end of the body to a bottom end of the body, the cylinder further comprising a step between a lower portion and an upper portion of the cylinder, the upper portion of the cylinder having a larger diameter, a bottom of the lower portion of the nib configure doe contacting a surface of a nail. The upper portion of the nib can further comprise an additional step at the top end of the nib, the step at the top end resulting in a top portion with a smaller diameter.

Provided is a nail pen comprising: a) a nail pen housing inside of which is a reservoir for varnish; b) a valve to stop flow of varnish; c) a mechanism configured to be actuated by a user to open the valve and allow varnish to flow to other side of the valve; d) a nib made from a material that is configured to allow for movement of varnish from inside of the nail pen after the valve and to the nib, and from the nib to a nail; e) a guide that is non-absorbent to the varnish, the guide extending below a surface of the nib that is configured to apply varnish to the nail; and f) a cavity at one end of the nail pen configured to receive the nib; wherein a user applies a strip of the varnish to a distal portion of the nail by holding the guide against an edge of the nail and moving the nail pen along the distal portion of the, nail so that the surface of the nib holding, the varnish contacts the distal portion of the nail to apply varnish to the nail; wherein the nib and the guide are in an assembly.

BRIEF DESCRIPTION OF THE FIGURES

FIG. 10 illustrates a nib-guide assembly.

FIG. 10*a* illustrates a nib-guide assembly.

FIG. 10*b* illustrates a nib-guide assembly (exploded view).

FIG. 10*c* illustrates a nib-guide assembly.

FIG. 10*d* illustrates a nib-guide assembly.

FIG. 11 illustrates a nib-guide assembly (rear view).

FIG. 11*a* illustrates a nib-guide assembly (side view).

FIG. 11*b* illustrates a nib-guide assembly (exploded view).

FIG. 11*c* illustrates a nib-guide assembly (iso rear bottom view).

FIG. 11*d* illustrates a nib-guide assembly (iso rear top view).

FIG. 12 illustrates a nib-guide assembly (rear view).

FIG. 12*a* illustrates a nib-guide assembly (side view).

FIG. 12*b* illustrates a nib-guide assembly.

FIG. 12*c* illustrates a nib-guide assembly (iso rear bottom view).

FIG. 12*d* illustrates a nib-guide assembly (iso rear top view).

DETAILED DESCRIPTION OF THE INVENTION

The present invention obviates this dilemma by presenting an apparatus for applying nail varnish in a controlled, uniform manner along the distal perimeter of a nail with significantly fewer imperfections or inconsistencies with the distribution of nail varnish on the distal nail perimeter. As used herein, distal portion of the nail refers to the edge of the nail exposed at the finger tips.

Figure 1:
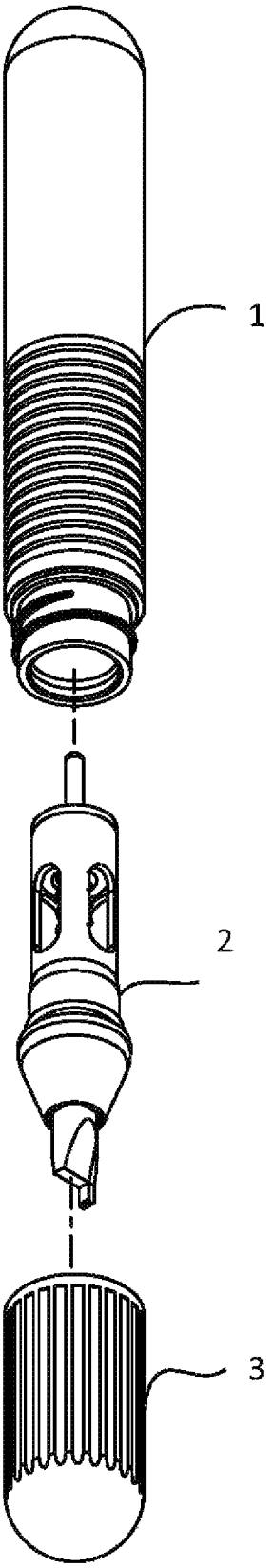
FIG. 1 illustrates an exploded view of a nail pen.
Figure 3:
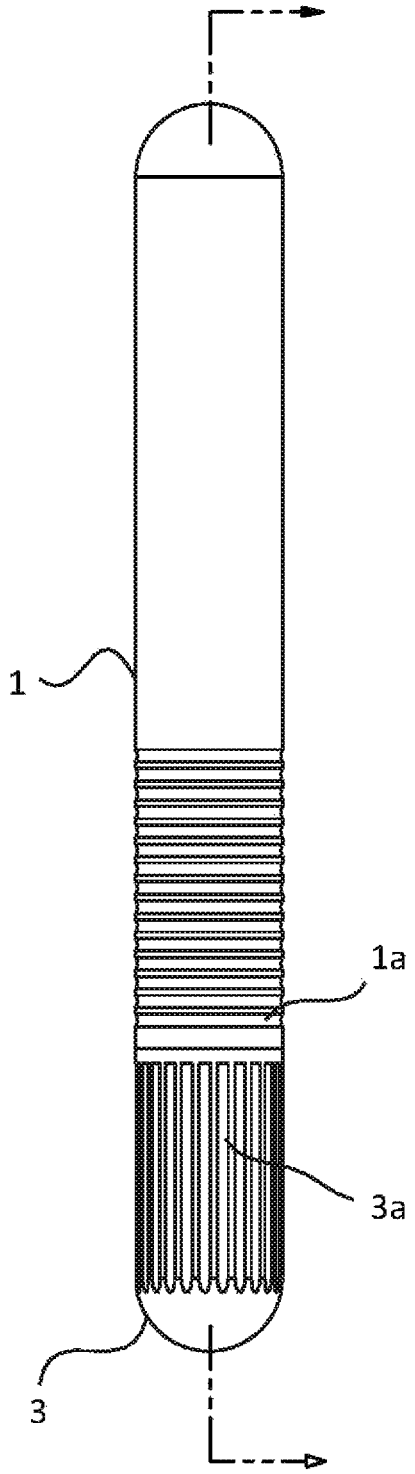
FIG. 3 illustrates a side view of a nail pen.

FIG. 1 illustrates the components of a nail pen, which include barrel 1, valve pump nib assembly 2 (connected together), and optional cap 3. Barrel 1 can be made from a hollow cylinder with one closed end and one open end, inside of the cylinder configured to store varnish. Valve pump nib assembly 2 is placed in the open end of barrel 1. Barrel 1 can have thread on the inside of its, open end that are complementary to threads on valve pump nib assembly 2, and can be attached together by the complementary threads. Cap 3 can be attached to barrel 1 to avoid exposure of valve pump nib assembly 2 to air. Cap 3 can have threads and be attached to threads on outside of open end of barrel 1. FIG. 3 illustrates nail pen with cap 3 coveting the valve pump nib assembly 2.

Figure 2:
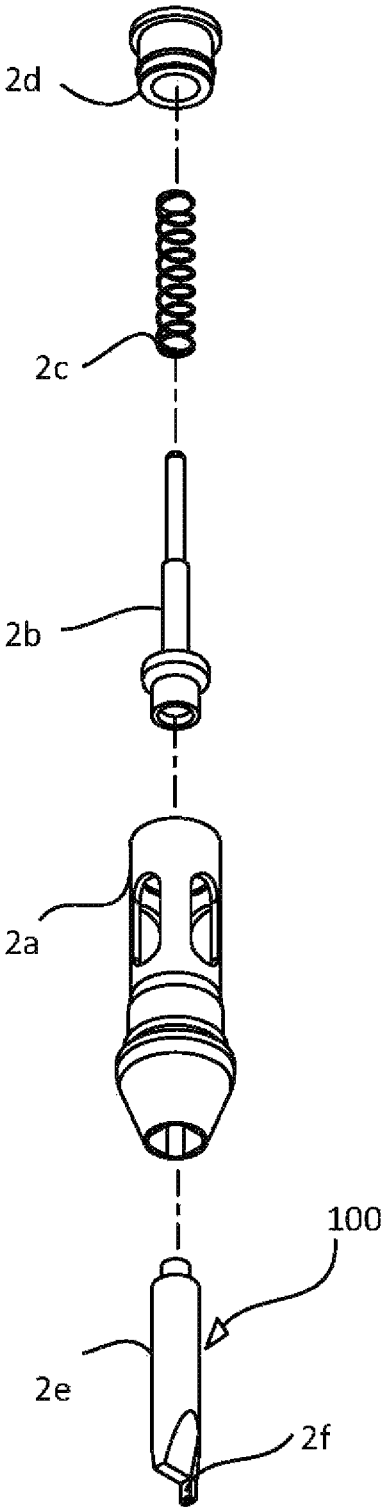
FIG. 2 illustrates an exploded view of valve/pump with nib/guide assembly.

FIG. 2 illustrates components of valve pump nib assembly 2. Nib 2*e* (part projecting out of the opening of the nail pen) and nib guide 2*f* form a unitary piece that is placed inside of valve housing 2*a*. Valve housing 2*a* has a circular opening at its bottom and top, and a channel inside, which are configured to receive nib 2*e* and allow for movement of nib 2*e* inside of housing 2*a* in response to a force applied to unit 2*e*. Top of nib 2*e* is complementary to bottom of valve door 2*b*. The circular cavity on bottom of valve door 2*b* receives top portion of nib 2*e*. Valve door 2*b* also has a stem portion, over which spring 2*e* is placed. Stem of valve door 2*b* has two different diameters, with lower portion of the stem having a larger diameter (thicker). Valve compression spring retainer 2*d* is placed on the top opening of valve housing 2*a*. Valve compression spring retainer 2*d* snaps in, and can maintain lower portion of valve door 2 inside of housing.

When nib 2*e* is pressed against the nail, nib 2*e* puts an upward pressure of valve door 2*b*. Valve door 2*b* moves upward as regulated by spring 2*c*. In ordinary position without compression, top of stem of valve door 2*e* goes through an opening on top of valve compression spring retainer 2*d* (see FIG. 1). When nib 2*e* moves upward, valve door 2*b* also moves upward. The upward motion of valve door 2*b* is limited by the larger diameter of lower portion of stem of valve door 2*b*. The lower portion of stem of valve door 2*b* does not fit through the opening of valve compression spring retainer 2*d*, maintaining the lower portion of stem of valve door 2*b* at all times inside of valve housing 2*a*.

FIG. 3 illustrates the nail pen of FIG. 1 with cap 3. The cap 3 can have a cap screw knurl 3*a*.

Figure 4:
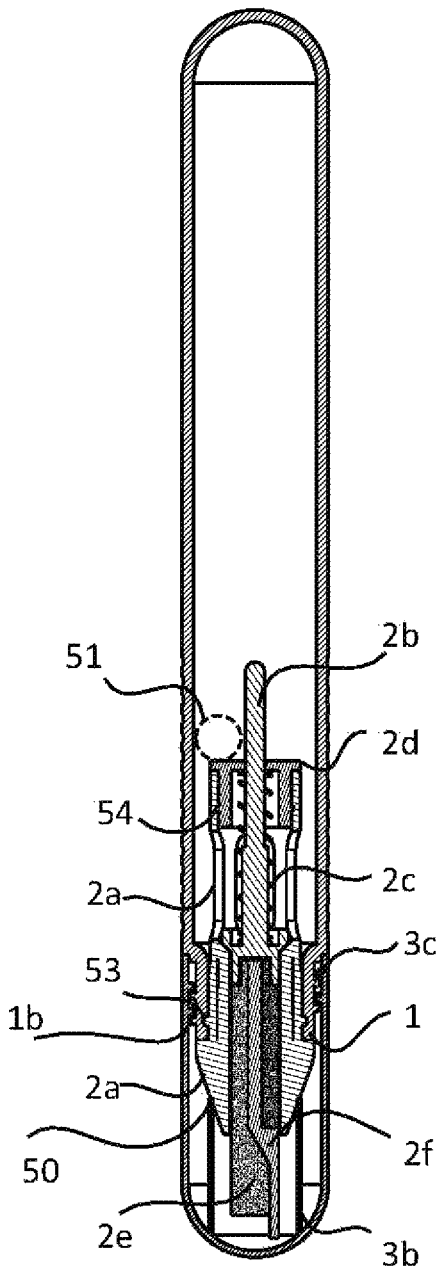
FIG. 4 illustrates an cross section of a nail pen.

FIG. 4 is a cross section view of the nail pen illustrated in FIG. 3. Nib 2*e* and guide 2*f* are complementary and form a cylinder. Guide 2*f* comes down further than nib 2*f* so to contact the edge of a nail. Bottom of nip 2*e* is configured to contact a person's nail and transfer varnish to the nail. The top of nib 2*e* has a portion with a smaller diameter, which is configured to fit into cavity of valve door 2*b*. Valve door 2*b* has a stem of varying diameter, with a top portion of a smaller diameter configured to slidably pass through opening of valve spring retainer 2*d*. The lower stem portion of valve door 2*b* cannot pass through opening of valve spring retainer 2*d*, and is limited in its motion. Nib 2*e* and valve door 2*b* are maintained in valve housing 2*a*, and slide in a channel that runs through valve housing 2*a* in a vertical direction. Valve spring retainer 2*d* snaps to top of the valve housing 2*a*, and seals the top end of the vertical channel in valve housing 2*a* other than for a small opening that is configured to allow movement of the upper stem portion of valve housing 2*b*. Agitator ball 51 allows for mixing the varnish by moving the nail pen. Nozzle 50 has an opening cavity inside for placing nib assembly 100.

Figure 5:
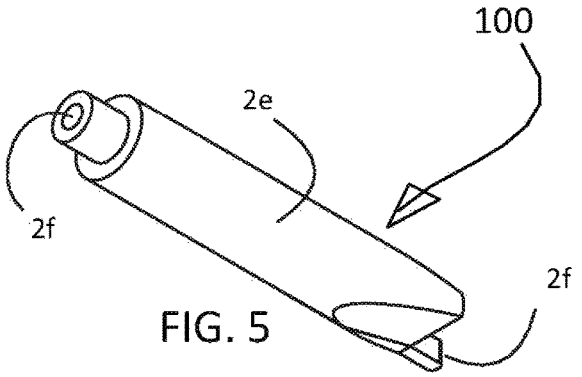
FIG. 5 illustrates a nib-guide assembly (overmold) (iso front view).
Figure 5A:
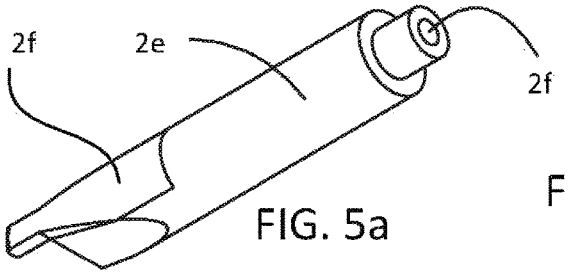
FIG. 5*a* illustrates a nib-guide assembly (overmold) (iso back view).
Figure 5B:
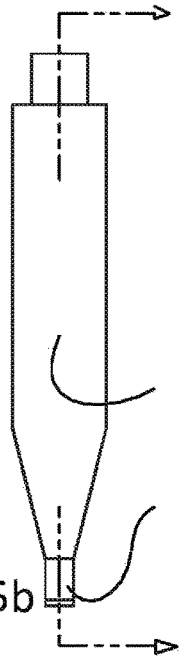
FIG. 5*b* illustrates a nib-guide assembly (overmold) (iso front view).
Figure 5C:
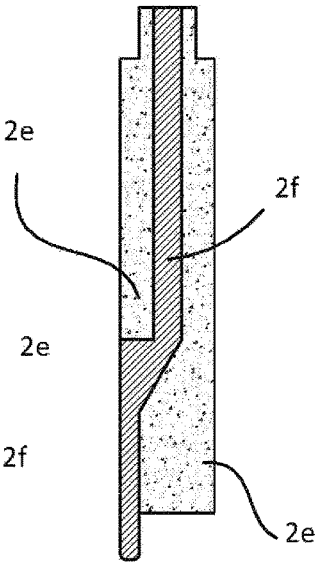
FIG. 5*c* illustrates nib-guide assembly (overmold) (cross section).

FIG. 5 illustrates a single unit comprising of both nib 2*e* and guide 2*f*. As illustrated in FIGS. 5*a*, 5*b*, and 5*c*, nib 2*e* has a cylindrical shape with a top portion having a diameter smaller than the diameter of the body of nib 2*e*. The bottom of nib 2*e* tapers down to form a rectangle-shaped contact surface for contacting the nail. In all embodiments of the present invention, other nib shapes can be used, including those that make contact with the nail with a circular pointed bottom (like a traditional pen or pencil). Alternative nib shapes for surface of the nib contacting the nail can he oval, semi-circle, or square. The assembly of the guide and the nib in any embodiment can be cylindrical (circle), oval, semi-circle, rectangle, and square.

Figure 6:
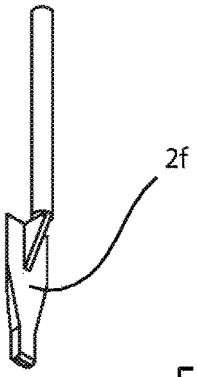
FIG. 6 illustrates a guide connected to a shaft (isometric view).
Figure 6A:
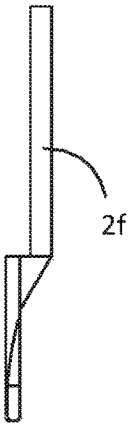
FIG. 6*a* illustrates a guide connected to a shaft (side view).
Figure 6B:
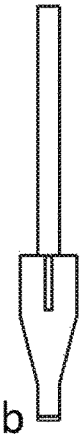
FIG. 6*b* illustrates a guide connected to a shaft (back view).
Figure 6C:
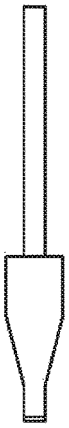
FIG. 6*c* illustrates a guide connected to a shaft (front view).

FIG. 6 (and FIGS. 6*a*, 6*b*, 6*c*) illustrates nib guide 2*f* of FIG. 5. As illustrated in FIGS. 6, 6*a*, 6*b*, and 6*c*, guide 2*f* has a guide portion that is configured for contacting the edge of a nail and a rod portion configured to run in the center of nib 2*e* in a vertical direction. The guide and the rod portions can be formed as a weldment. The contact portion of guide 2*f* is positioned on outside of nib 2*e*, and can be shaped to form a uniform cylindrical body with nib 2*e*. Rod portion of nib guide 2*f* is configured to contact valve door 2*b* and can be co-axial with nib 2*e*.

Figure 7:
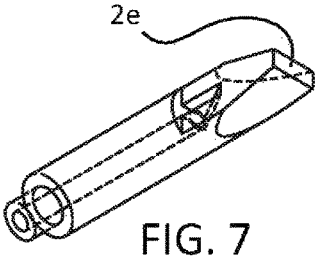
FIG. 7 illustrates a nib (isometric back view).
Figure 7A:
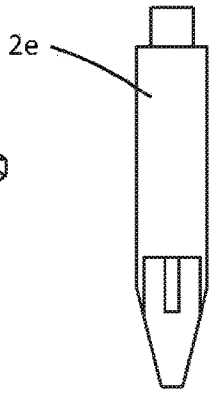
FIG. 7*a* illustrates a nib (side view).
Figure 7B:
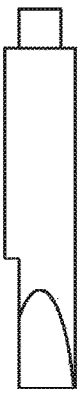
FIG. 7*b* illustrates a nib (back view).
Figure 7C:
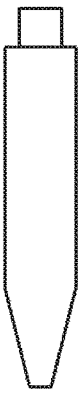
FIG. 7*c* illustrates a nib (front view).

FIG. 7 (including FIGS. 7*a*, 7*b*, 7*c*) illustrates nib 2*e* without nib guide 2*f*. Nib 2*e* has a bottom rectangular surface configured to contact a nail and apply varnish to the nail. FIGS. 7*a* and 7*b* illustrate portions in nib 2*e* that are configured to receive guide 2*f*, Nib 2*e* also has a channel running along inside at its center configured to accept the rod of guide 2*f*.

Figure 8:
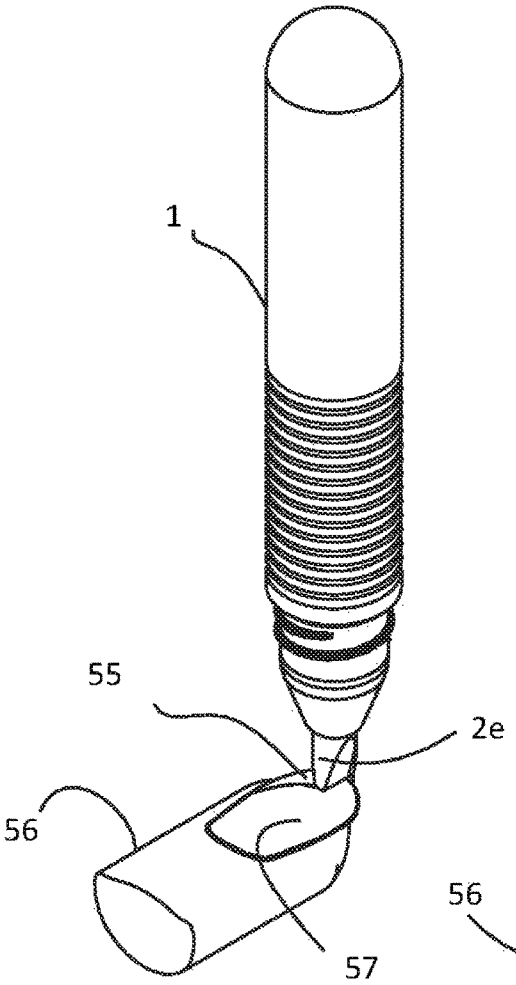
FIG. 8 illustrates a nail pen applying a band of varnish (isometric view).
Figure 8A:
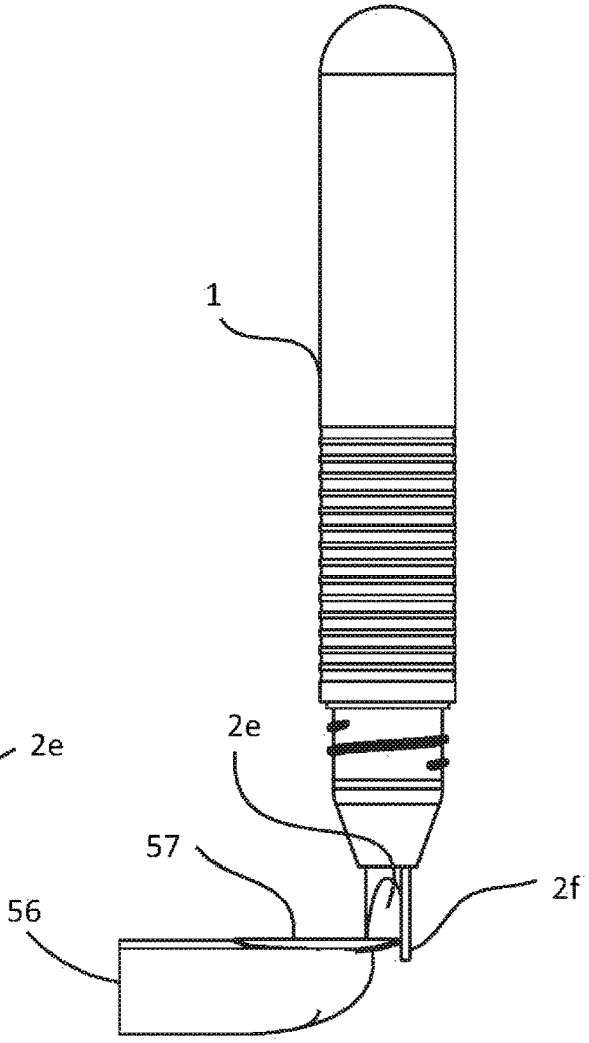
FIG. 8*a* illustrates a nail pen applying a band of varnish (isometric view).

FIGS. 8 and 8*a* illustrate application of a French manicure to a distal portion of the nail. French manicure is a style of manicure in which the nails 56 of finger 57 are painted with a band of varnish at the tip. The band 55 is typically white. The white band at the tip of the nail is approximately equidistant from the edge of the nail, requiring a steady hand to apply the band of varnish, which is typically white. As illustrated in these figures, the nail pen is held in the hand by its barrel 1. The nail pen is moved from one side of the nail 57 to other side at the edge of nail 57. Guide 2*f* is held against edge of the nail and limits how far nib 2*e* can travel to the proximal portion of the nail. A user moves the nail pen by positioning the nail pen's guide 2*f* against the edge of nail 57, and then moving the nail pen from one side of nail 57 to another side to apply a band of French manicure 55. The guide 2*f* can be smaller in length and/or narrower than that illustrated in FIG. 8*a*, and only slightly extend below the nail. Guide 2*f* can be curved or slightly angled towards the nail.

Figure 9:
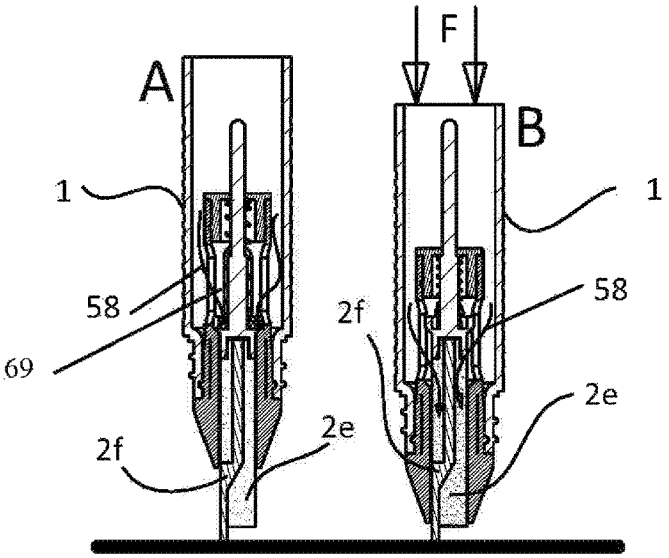
FIG. 9 illustrates positioning a nail pen against a nail surface before and after the nail pen is pressed against the nail.

FIG. 9 illustrates actuating the valve of the nail pen to allow varnish 58 flow from inside of barrel 1 which has a varnish 58 reservoir through the side openings 69 on valve housing 2. The varnish 58 then travels from the side openings 69 that are in proximity to the top of nib 2*e* to bottom of nib 2*e*. When not in use (A), the valve is closed by valve door 2*b*. When nib 2*e* of nail pen is pressed against nail 57, nib 2*e* pushed up valve door 2*b*, resulting in varnish 58 making physical contact with nib 2*e*. The movement in figure nine is exaggerated for illustration purposes. The nail pen needs to move slightly down for the varnish to release.

FIG. 10 illustrates an alternative manner to construct an assembly of a nib and a guide. In this embodiment, illustrated in FIGS. 10, 10*a*, 10*b*, 10*c*, 10*d*, nib 3*d* is attached to guide 3*b* through adhesive 3*c*. Guide 3*b* can have a flat inside flat surface which complements a flat side of nib 3*d*. Guide 3*b* runs along the length of nib 3*d*. Guide 3*b* is flat on the inside arid circular/curved on the outside, so that after attachment to nib 3*d*, forms a cylindrical assembly. As illustrated in FIGS. 10*c* and 10*d*, the portion of guide 3*b* extends below the bottom rectangular surface of nib 3*d* and is positioned on the short side of the rectangular surface. Guide 3*b* can be made from a metal, non-metal, or a rigid synthetic material like plastic.

Figure 26:
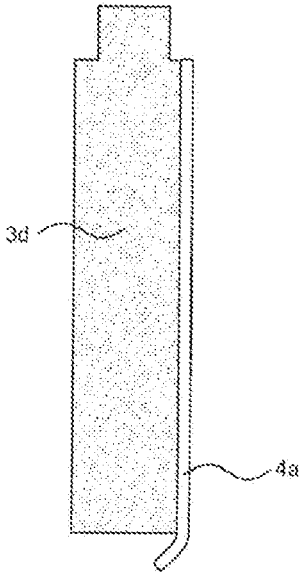
FIG. 26 illustrates a guide positioned on outside of the nib extending below the nib and bending towards the nib (cross-section).
Figure 27:
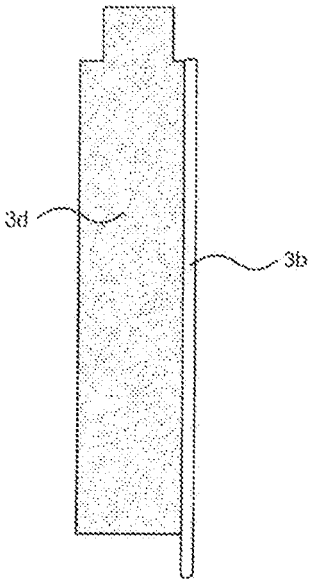
FIG. 27 illustrates a guide positioned on outside of the nib extending below the nib in a straight form without bending (cross-section).

FIGS. 11 (and 11*a*, 11*b*, 11*e*, 11*d*) illustrates the same assembly as FIG. 10. In this case the portion of the guide extending below the rectangular bottom surface of nib 3*d* is also positioned on the short side of the rectangle. In this embodiment, the guide curves and/or bends 59 towards the bottom surface of nib 3*d*. The guide can bend in a straight fashion at an angle or in a curved fashion. FIG. 27 illustrates another embodiment where guide 3*b* extends below the nib 3*d* and remains straight without bending. FIG. 26 illustrates the guide 4*a* bending at an angle towards the nib 3*d* when it goes below the lower surface of nib 3*d*.

Figure 25:
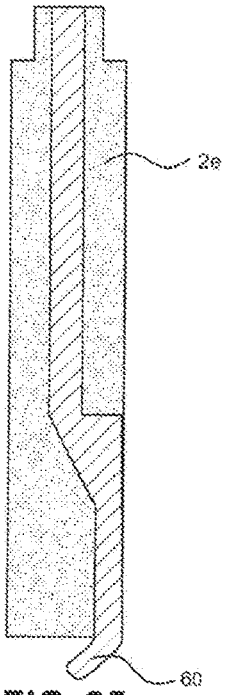
FIG. 25 illustrates a guide bending towards a nib (cross-section).

FIGS. 12 (and 12*a*, 12*b*, 12*c*, 12*d*) illustrate the same assembly as FIG. 5 except in this case the portion of the guide 60 extending below the rectangular bottom surface of nib 2*e* curves or bends at an angle towards the bottom surface of nib 2*e*. In FIG. 12, the guide 60 has a first vertical portion that extends below the lowest surface of the nib 2*e* and a second portion that bends towards nib 2*e*. In FIG. 25, the guide 60 immediately bends at an angle towards nib 2*e* without having a vertical portion below the nib surface.

Figure 13:
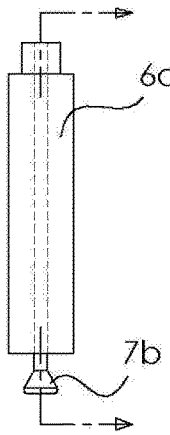
FIG. 13 illustrates a center guided nib (front view).
Figure 13A:
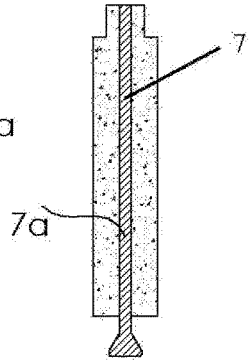
FIG. 13*a* illustrates a center guided nib (cross section view).
Figure 13B:
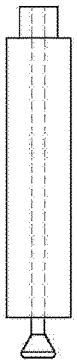
FIG. 13*b* illustrates a center guided nib (side view).
Figure 13C:
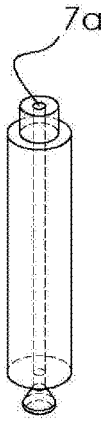
FIG. 13*c* illustrates a center guided, nib (iso top view).
Figure 13D:
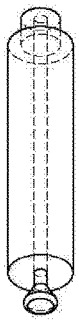
FIG. 13*d* illustrates a center guided nib (iso bottom view).
Figure 22:
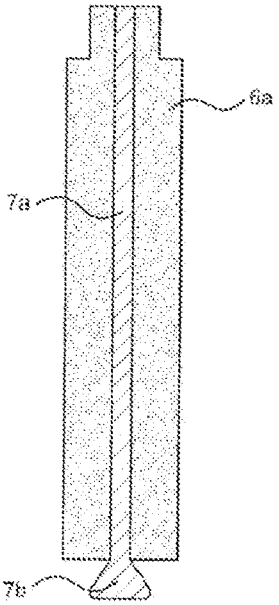
FIG. 22 illustrates another embodiment of a center guided nib of FIG. 13 (cross-section).
Figure 24:
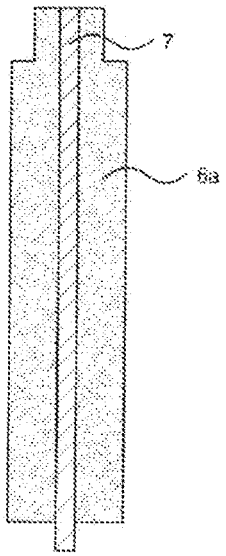
FIG. 24 illustrates a guide that runs along the center of a cylindrical nib (cross-section).

FIG. 13 (and FIGS. 13*a*, 13*b*, 13*c*, 13*d*) illustrate a nib assembly with the guide 7 (7*a*) running along the center of the cylindrical nib 6*a*. The guide 7 has a shaft 7*a* that runs along the center of nib 6*a*. The guide 7 also has a pin head 7*b*. In one embodiment, shaft 7*a* extends below nib 6*a* to create a gap (between pin head 7*b* and bottom of nib 6*a*) for placing tip of the nail before shaft 7*a* expands to form pin head 7*b*. In another embodiment, as illustrated in FIG. 22, a smaller or a minimal gap exists between pin head 7*b* and bottom of nib 6*a*. Pin head 7*b* is formed at the bottom portion of shaft 7*a* and can have a curved conical frustum shape, increasing in diameter as extending below nib 6*a*. In another embodiment, illustrated in FIG. 24, the guide 7 runs along the center of the cylindrical nib 6*a* and comes out of the bottom surface in the same shape without forming a pin head. The guide 7 can be a cylinder with a diameter of the typical staple.

Figure 14:
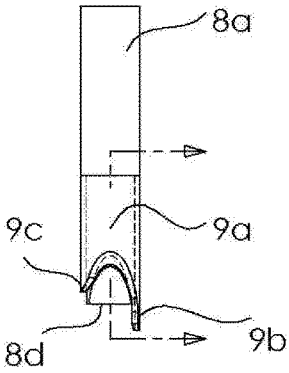
FIG. 14 illustrates a ferrule guided nib (side view).
Figure 14A:
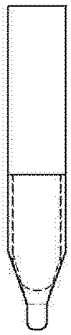
FIG. 14*a* illustrates a ferrule guided nib (front view).
Figure 14B:
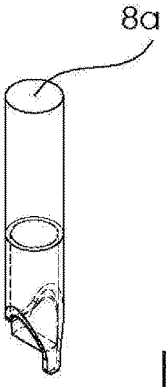
FIG. 14*b* illustrates a ferrule guided nib (iso top view).
Figure 14C:
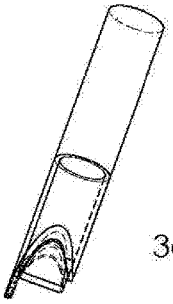
FIG. 14*c* illustrates a ferrule guided nib (iso bottom view)
Figure 14D:
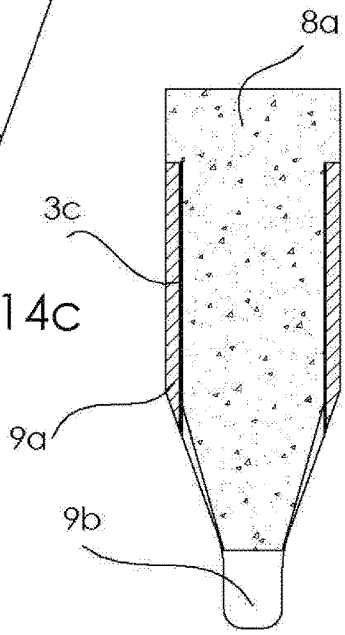
FIG. 14*d* illustrates a ferrule guided nib (cross section view).
Figure 14E:
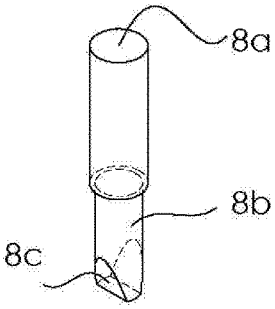
FIG. 14*e* illustrates a ferrule guided nib (iso rear bottom view).
Figure 14F:
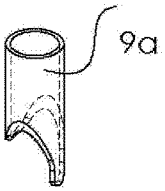
FIG. 14*f* illustrates a ferrule guided ring (iso rear bottom view).
Figure 23:
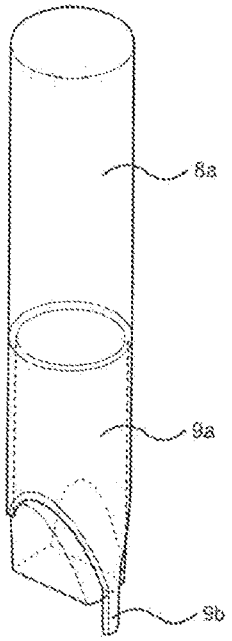
FIG. 23 illustrates the ferrule design with a smaller guide.
Figure 31:
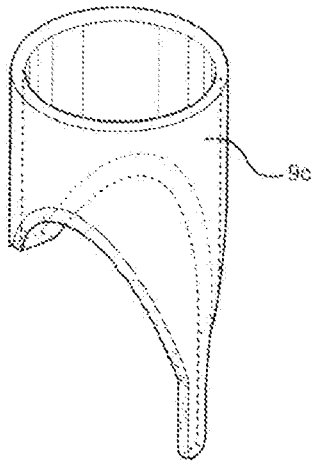
FIG. 31 illustrates a ferrule design with a shorter height.
Figure 32:
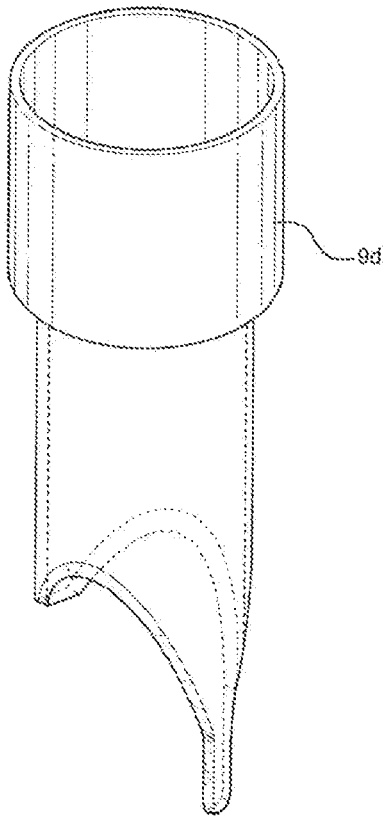
FIG. 32 illustrates a ferrule design with a step/recess.

FIG. 14 (and FIGS. 14*a*, 14*b*, 14*e*, 14*d*, 14*e*, and 141) illustrate a guide 9*b* with a body ferrule 9*a* that forms a sleeve around nib 8*b*. The ferrule body 9*a* is like a sleeve or an empty cylinder that wraps around nib 8*b*. Nib 8*b* can have a smaller diameter than the upper portion of nib 8*a* to complement and receive the ferrule body 9*a*, and to maintain the ferrule body 9*a* in place. As illustrated in FIG. 14*d*, ferrule body 9*a* and the top portion of nib 8*a* are flush to each other and form a uniform surface. The lower sides of guide 9*a* can have curved shaped void portions (ferrule recessed sides 9*c*) and correspond to the contour of nib 8*a*. Guide 9*b* extends further below the lowest portion of nib 8*b* and is configured to contact tip of a nail. An adhesive 3*c* can be use used to attach ferrule body 9*a* to nib 8*b*. In one embodiment, in this nib-guide assembly, in anon-deployed position, the top portion of nib 8*a* is placed inside an opening at the bottom of a nail pen, and ferule body 9*a* can stay completely or partially outside of the opening and either go or not go inside of the nail pen. In another embodiment, ferrule body 9*a* covers more than 50% of outside of nib 8*a* (such as 100%), and both ferrule body 9*a* to nib 8*a* are placed at least partially inside of the opening of the pen in a non-deployed position. In another embodiment, ferrule body 9*a* covers 10 to 30% or 30% to 50% of outside of the nib 8*a*. As illustrated in FIG. 23, in one embodiment, guide 9*b* has a smaller width than the side of nib 8*a*, which corresponds to one side of the rectangular bottom surface making contact with the nail. Nib 8*a* has a step or a recess that stabilizes the assembly. FIG. 31 illustrates Ferrule/sleeve 9*c* with a shorter height (the ring portion is smaller). FIG. 32 illustrates a ferrule/sleeve 9*d* with a step that complements the step of nib 8*a*.

Figure 15:
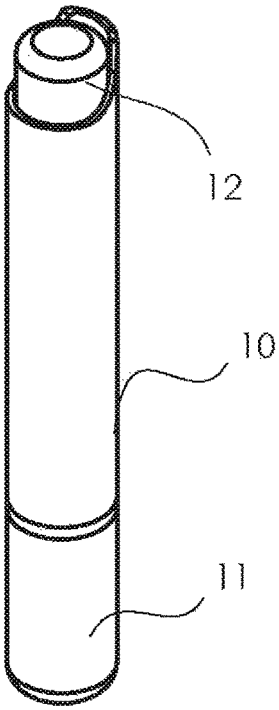
FIG. 15 illustrates a rear push button manicure applicator (iso top view).

FIG. 15 illustrates manicure nail pen (perspective top view) with atop push button 12. The nail pen has body 10, cap 11, and valved container 12. The top of valved container 12 is accessible from outside of body 10 and acts as a button that can be pushed to release varnish from the barrel 1 to a nib.

Figure 16:
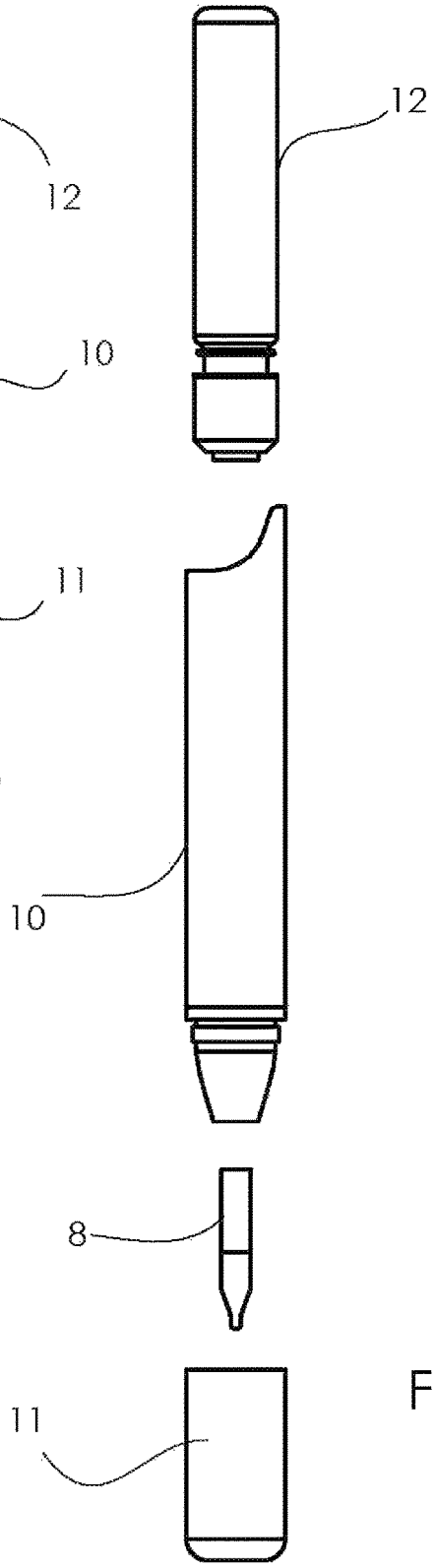
FIG. 16 illustrates a rear push button manicure applicator (exploded view).

FIG. 16 illustrates components of the nail pen of FIG. 15 (exploded, view). The components of the nail pen include body 10, cap 11, and valved container 12. Valved container 12 is placed inside body 10 and slide against inside of body 10 when pressed from the top. The top of valved container 12 is exposed and accessible to a user to press down. Nib 8 (such as that configured to receive ferrule 9*a*) is placed inside the opening (cavity) at bottom end of body 10.

Figure 17:
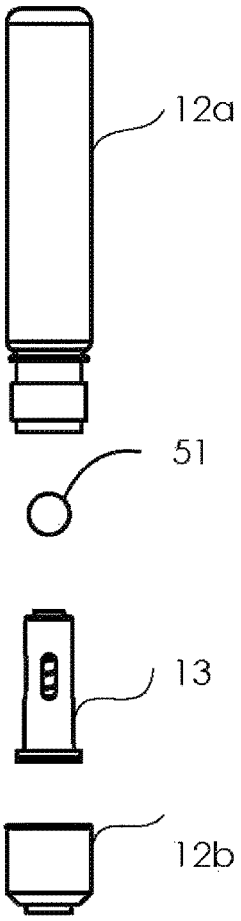
FIG. 17 illustrates a valved container (exploded view).

FIG. 17 illustrates components of valved container 12 (exploded view). Valved container 12 can include manicure liquid container 12*a* which holds the varnish inside. Valved container 12 can further include cap 12*b*, Valve/pump assembly 13, and agitator ball 51. Varnish enters the Valve/pump assembly 13 from openings on the side 69 and exits the Valve/pump assembly 13 through an opening at the bottom of the assembly 13 and then an opening in cap 12*b*. FIG. 31 illustrates ferrule 9*c* where the portion that goes around the nib has a lower height (a ring with a thin band). FIG. 32 illustrates ferrule 9*d* where the ferrule has a step that complements the step in nib. Ferrule 9*d* has a lower portion and an upper portion, with the upper portion having a slightly larger diameter that forms a recess/step with the lower portion.

Figure 18:
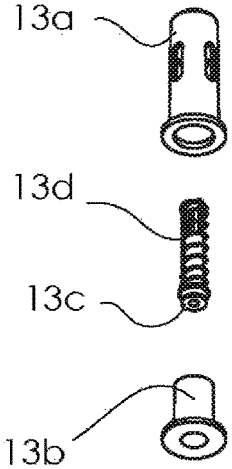
FIG. 18 illustrates a valve/pump assembly (exploded view).

FIG. 18 illustrates valve/pump assembly 13 (exploded view) having valve/pump housing 13*a*, valve seat 13*b*, valve 13*c*, and compression spring 13*d*.

Figure 19:
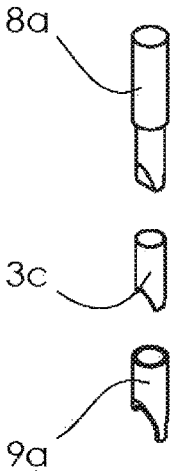
FIG. 19 illustrates a ferrule guided nib assembly (exploded view).

FIG. 19 illustrates ferrule guided nib assembly (exploded view) with adhesive 3*c* (gap filling ultra-gel control for example LOCTITE ultra-gel adhesive), nib 8*a*, and ferrule body 9*a*. Nib 8*a* has a lower diameter in the bottom portion and is configured to accept Ferrule body 9*a* at the lower portion.

Figure 20:
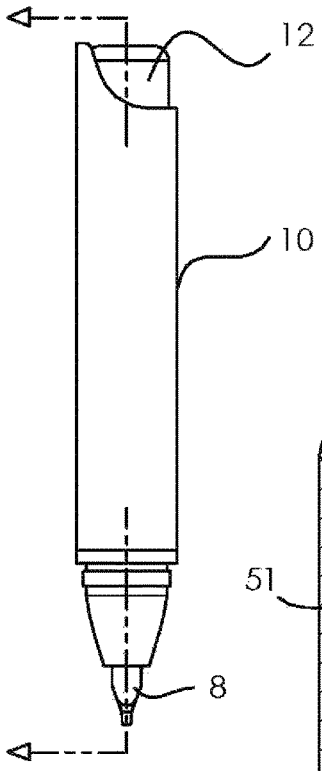
FIG. 20 illustrates a push button French manicure applicator normal position (side view).

FIG. 20 illustrates a push button French manicure applicator (nail pen) in a normal position (non-deployed) (side view) with nib-guide assembly (such as ferrule guided nib assembly 8), Body 10, and valved container 12.

Figure 20A:
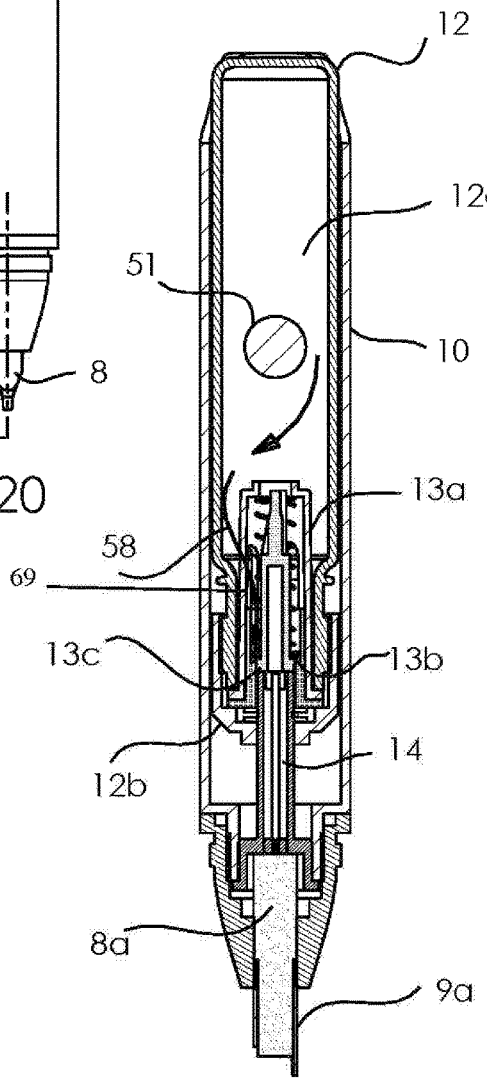
FIG. 20*a* illustrates a push button French manicure applicator normal position (cross section).

FIG. 20*a* illustrates a push button French manicure nail pen in a normal position (cross section) (non-deployed) with nib 8*a*, ferrule body 9*a*, body 10, valved container 12, container cap 12*b*, Manicure liquid (varnish) 12*c*, valve Housing 13*a*, valve seat 13*b*, valve 13*c*, manicure liquid feed channel 14, agitator ball 51, and varnish flow 58. In this position the valve assembly is closed since valve 13*c* is sitting on valve seat 13*b*. Valve 13*c* is in a closed position and varnish is not moving to nib 8*a*.

Figure 21:
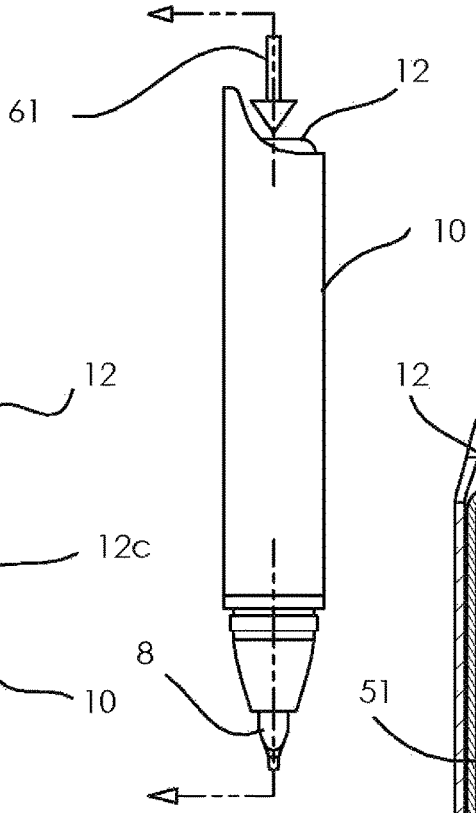
FIG. 21 illustrates push button French manicure applicator pressed position (side view).

FIG. 21 illustrates a push button French manicure nail pen of FIG. 20 in a pressed position (deployed) (side view). The button 12 is pushed or pressed in a downward direction 61.

Figure 21A:
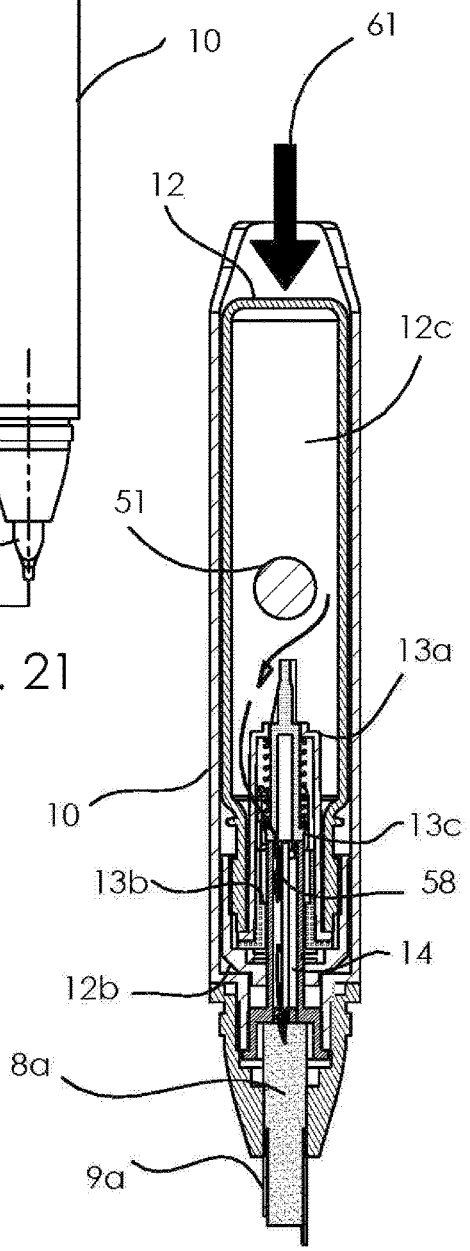
FIG. 21*a* illustrates a push button French manicure applicator pressed position (cross section).

FIG. 21*a* illustrates a push button French manicure nail pen in a pressed position (cross section). The nail pen is illustrated with nib 8*a*, ferrule body 9*a*, body 10, valved container 12, container cap 12*b*, manicure liquid (varnish) 12*c*, valve housing 13*a*, valve seat 13*b*. Valve 13*c*, manicure liquid feed channel 14, agitator ball 51, varnish flow 58, and push direction arrow 61. When a user presses down push button 12, valve 13*c* stays in a fixed position, while valve seat 13*b* moves down along with valve housing 13*a*. Valve housing 13*a* has an, opening on top that allows it to slide while valve 13*c* is in a stationary position. Top portion of valve 13*c* sticks out of the opening on top of valve housing 13*a*. After the valve seat 13*b* moves down, valve 13*c* is in an open (deployed) position, and then varnish flows from outside of valve housing 13*a* to inside of valve housing 13*a* from opening 69, and then goes outside of 13*a* from an opening in valve seat 13*b*. Varnish leaving valve housing 13*a* moves down channel 14 and then into nib 8*a*. Channel 14 has an end inside of cap 12*b*, and is in fluid communication with both valve housing 13*a* and nib 8*a*. Valve housing 13*a* also slides against channel 14, while channel 14 and valve 13*c* are in a fixed position.

Figure 28:
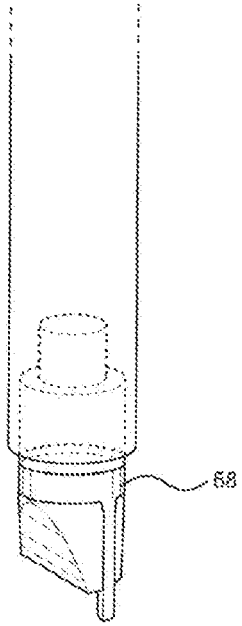
FIG. 28 illustrates a ring around a nib, and a guide attached to the ring and extending below the lowest surface of the nib for contacting the nail.
Figure 29A:
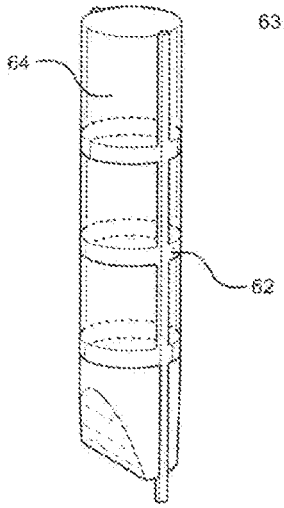
FIG. 29A illustrates an assembly of a guide with rings and a nib with grooves.
Figure 29B:
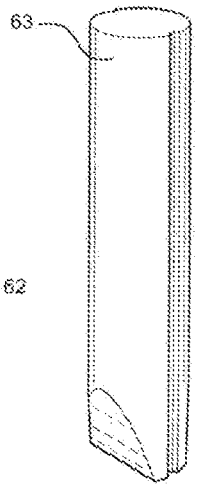
FIG. 29B illustrates a nib with a groove.
Figure 29C:
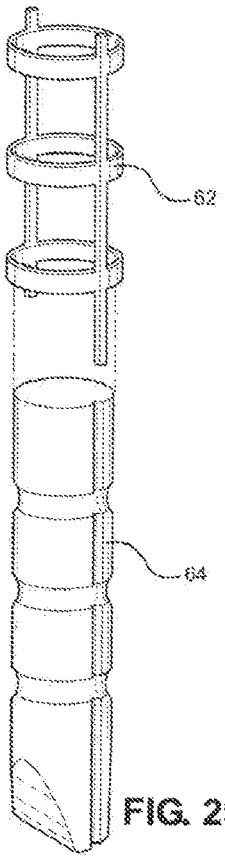
FIG. 29C illustrates an exploded view of a guide and a nib.
Figure 29D:
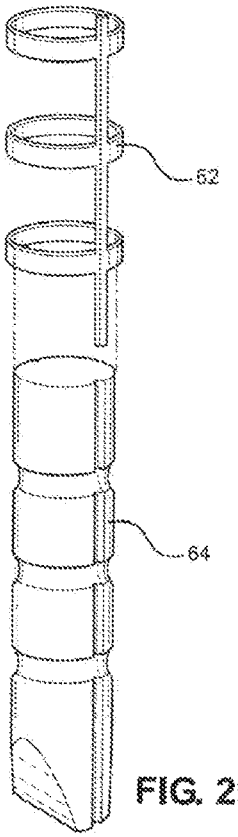
FIG. 29D illustrates an exploded view of a guide and a nib.

FIG. 28 illustrates a ring around a nib, and a guide 68 attached to the ring and extending below the lowest surface of the nib for contacting the nail. The nib of FIG. 28 can have grooves for accepting the ring and/or guide, so that the ring and the guide are flush and form a uniform surface.

FIGS. 29 (and 29*a*, 29*b*, 29*c*, 29*d*) illustrates one or more rings and a guide 62 and an optional scaffold support. The nib 63 can have one or more grooves that run along the length of the nib for accepting the guide and/or the scaffold. The nib 64 can also have one or more grooves that run along in a horizontal manner for accepting one or more of the rings of guide 62. The rings/scaffold/guide 62 can be made from one piece of material and can be placed on the complementary grooves on the surface of the nib 63, 64, and can form a flush/uniform surface. The guide 62 can have one, two or three rings.

Figure 30:
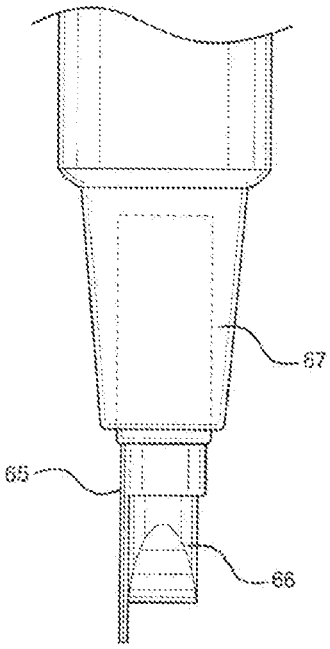
FIG. 30 illustrates a nail pen with a guide.

FIG. 30 illustrates a guide that is formed around nib 66 from a member that surrounds the upper portion of the nib 66 and is partially inside of the nail pen housing 67. In this embodiment, a circular member 65 which forms a guide goes around a portion of cylindrical nib 66 and its upper portion is placed inside of the nail pen housing 67.

The guide can be made of a hard material such as stainless steel and or hard plastic such as UItem™ (Polyetherimide).

Any of the nibs (such as 2*e*, 8) can be made of porous, pressed fibers such as felt. One option for the base material of porous nib can be PE (Polyethylene). Nib assembly 100 or other assemblies can have a total height that is about 1 to about 3 centimeters, such as about 2 to about 3 cm (such as 29.5 mm or 21.5 mm) and a diameter of about 2 mm to 8 mm, or about 3 mm to about 6 mm, such as about 5 mm or 4.5 mm (measured at a position of the nib that is placed inside the nail pen having the maximum diameter). Nib 2*e* is slanted on both sides to form a rectangular flat surface on its bottom with about 1 to 2 mm for the shorter side and about 2 to 6 mm for the longer side, such as about 1.5 mm for the shorter side and about 4 mm for the longer side. Guide 2*f* can protrude below the flat rectangular surface (measured in a vertical plane) of item 2*e* or other nib surfaces by approximately about 0.5 to about 3 mm, such as about 1 mm, or about 2 mm, or about 2.5 mm, and may be at an angle.

Varnish can move down any of the nibs by gravitational force and/or diffusion. The movement of varnish can further be accelerated by a mechanism that can put a force on the varnish inside of the pen to force the varnish into the nib. Nibs can be made of absorbent materials (soaks up varnish) and the guide is made from a non-absorbent (does not soak up varnish) material. Nibs can also be made from non-absorbent materials that with a particular type of varnish allow for movement of varnish. In this embodiment, the nibs can have substantial number of pores that allow the varnish to flow without being absorbed by the material that forms the nib.

Each of the nib and the guide can be made from a single unitary piece of material. A mold can be used to make the guide. The nib can be made from a cylindrical, shaped material that is cut at regular spaced intervals. Other manufacturing methods can be used. The nib and the guide can be made into an assembly by over molding without-use of adhesive, use of an adhesive, and/or use of a step (FIG. 14) that limits the movement of the guide.

The nib can be removably attached to the nib. The nib with or without the guide can be removably attached/inserted into the nail pen body. The nib with or without the guide can also be non-removably attached/inserted into the nail pen body. The assembly of the nib and the guide can be both disposable and removable from the nail pen, or alternatively permanently attached to the nail pen.

As illustrated for example in FIG. 2, nib 2*e* can have a cylindrical shape. The lower part of the nib can taper to form a surface for contacting a nail. The upper part of the nib can also taper, by having for example a smaller concentric cylinder. As illustrated in FIG. 14, the nib can further have a step or recess between a first lower portion and a second upper portion. The second upper portion would have a larger diameter to create a step with a thickness that complements the thickness of a guide that is placed on the lower portion of the nib.

Nib fiber construction is configured to allow for passage of high viscosity pigmented manicure varnish. Water based varnish can be made of water, methyldibromo glutaronitrile, acrylates copolymer, propylene glycol, titanium dioxide, propylene, glycol butyl ether, dipropylene glycol butyl ether, trimethyl pentanyl diisobutyrate, sodium pca, ammonium hydroxide, ppg-26-buteth-26, butoxyethanol, modified alkylaryl polyether, dimethicone, silica. Alcohol based varnish can be made of aqua/water/eau, acrylates/ethylhexyl acrylate copolymer, isopropyl alcohol, styrene/acrylates copolymer, propylene glycol, laureth-21, sodium acrylate/acryloyldimethyl taurate copolymer, phenoxyethanol, alumina, aminomethyl propanol, ammonium hydroxide, silica, methylparaben, propylparaben, ethylparaben, titanium dioxide (ci 77891). Alcohol based varnish can be made of alcohol denat., methoxyisopropanol, acrylates copolymer, acetyl triethyl citrate, nitrocellulose, peg-12 dimethicone, acetyl tributyl citrate. ci 77891 (titanium dioxide), aluminum hydroxide, ci 19140 (yellow 5 lake). Alcohol based varnish can be made of alcohol, methoxyisopropanol, acrylastes copolyrner.

In some embodiments, the guide may not come in contact with any portion of the nail pen and/or not be attached to the nail pen, and be in contact only with the nib. In some embodiments, the guide is only secured and held place by the nib without any support from any portion of a nail pen, even when a portion of the guide enters the cavity of the nail pen.

REFERENCES

FIG. 1: Exploded view of manicure applicator
1. Barrel
2. Valve pump nib assembly
3. Cap
FIG. 2: Exploded view of valve/pump
2*a*. Valve housing
2*b*. Valve door
2*c*. Valve compression spring
2*d*. Valve compression spring retainer
2*e*. Nib
2*f*. Nib guide
100. Over-molded guided nib unit
FIG. 3: Side view of applicator assembly
1. Barrel
1*a*. Grip Knurl
3 Cap
3*a*. Cap screw knurl
FIG. 4: Applicator assembly cross section
1. Barrel
2*a*. Applicator nozzle
2*b*. Valve Stem
2C. Valve compression spring
2*d*. Valve spring retainer
2*e*. Nib
2*f*. Nib Guide
50. Nozzle seal area (part of cap screw)
51. Agitator ball
53. Nozzle/Barrel snap ring (mating rings)
54. Valve housing/valve retainer snap rings (mating rings)
FIG. 5: Guided nib overmold
2*e*. Nib
2*f*. Nib guide
100. Over-mold unit
FIG. 6: Guide, fused metal weldment (or non-metal)
2*f*. Nib guide
FIG. 7: Nib (isometric back view)
2*e*. Nib
FIG. 7: Nib
2*e*. Nib
FIG. 8: Manicure application

56. Finger
57. Fingernail
55. Applied French manicure
2*e*. Nib
FIG. 8: Manicure application
56. Finger
57. Fingernail
55. Applied French manicure
2*e*. Nib
2*f*. Guide
FIG. 9: Nib compression stages
A. Relaxed
B. Compressed
F. Applied force
1. Barrel
2*e*. Nib
2*f*. Guide
58. Liquid flow (varnish)
FIG. 10: Guided nib
3*b*. Metal or non-metal plate
3*c*. Adhesive
3*d*. Nib
FIG. 11: Guided nib
4*a*. Metal or non-metal plate, slanted tip
3*d*. Nib
59. Metal or non-metal plate'bend
FIG. 12
2*e*. Nib
5*a*. Metal or non-metal plate, slanted tip
60. Guide bend
101. Over-molded guided nib unit
FIG. 13: Center guided nib
6*a*. Nib
7*a*. Center guide phi shaft
7*b*. Center guide pin head
FIG. 14: Ferrule guided nib
3*c*. Adhesive (gap filling ultra-gel control for example LOCTITE BRAND ultra-gel adhesive)
8*a*. Nib
8*b*. Nib recessed area for ferrule mating
8*c*. Near slanted cut for narrow marking tip, 2 symmetrical places, near and far sides
8*d*. Marking tip surface
9*a*. Ferrule body
9*b*. Protruded ferrule guide
9*c*. Ferrule recessed side
FIG. 15: Rear push button manicure applicator
10. Body
11. Cap
12. Valved refill
FIG. 16: Rear push button manicure applicator
8. Ferrule guided nib assembly
10. Body
11. Cap
12. Valved refill
FIG. 17: Valved Container
12*a*. Manicure liquid container
12*b*. Container cap
13. Valve/Pump assembly
51. Agitator ball
FIG. 18: Valve/pump assembly
13*a*. Valve/Pump housing
13*b*. valve seat
13*c*. Valve
13*d*. Compression spring
FIG. 19: Ferrule guided nib assembly
3*c*. Adhesive (gap filling ultra-gel control for example LOCTITE BRAND ultra-gel adhesive)
8*a*. Nib
9*a* Ferrule body
FIG. 20: Push button French manicure applicator normal position
8. Ferrule guided nib assembly
10. Body
12. Valved refill
FIG. 20: Push button french manicure applicator normal position
8*a*. Nib
9*a*. Ferrule body
10. Body
12. Valved Container
12*b*. Container cap
12*c*. Manicure liquid
13*a*. Valve Housing
13*b*. valve seat
13*c*. Valve
14. Manicure liquid feed channel
51. Agitator ball
58. Liquid flow
69. Side Openings
FIG. 21: Push button French manicure applicator pressed position
8. Ferrule guided nib assembly
10. Body
12. Valved refill
61. Push direction arrow
FIG. 21*a* Push button French manicure applicator pressed position
8*a*. Nib
9*a*. Ferrule body
10. Body
12. Valved container
12*b*. Container cap
12*c*. Manicure liquid
13*a*. Valve Housing
13*b*. valve seat
13*c*. Valve
14. Manicure liquid feed channel
51. Agitator ball
58. Liquid flow
61. Push direction arrow
FIG. 22
6*a*. Cylindrical nib
7*a*. Shaft
7*b*. Pin head
FIG. 23
8*a*. Nib
9*a*. Ferrule body
9*b*. Guide
FIG. 24
6*a*. Nib
7. Guide
FIG. 25
2*e*. Nib
60. Guide with bend
FIG. 26
3*d*. Nib
4*a*. Guide
FIG. 27
3*b*. Guide
3*d*. Nib
FIG. 28
68. guide with ring FIG. 29
62. Guide with ring(s)
63. Nib with vertical groove
64. Nib with vertical and horizontal groove
FIG. 30
65. Guide
66. Nib
67. nail pen housing
FIG. 31
9*c*. Ferrule with lower heights (ring)
FIG. 32
9*d*. Ferrule with a step

What is claimed is:

1. An assembly for a nail pen comprising:

a) a nib made from a material that is configured to allow for movement of varnish from inside of the nail pen to the nib, and from the nib to a surface of a nail;

b) a guide made from a material that is non-absorbent to the varnish, the guide extending below a surface of the nib that is configured to apply varnish to the nail;

wherein a user applies a strip of the varnish to a distal portion of the nail by holding the guide against an edge of the nail and moving the nail pen along the distal portion of the nail so that the surface of the nib holding the varnish contacts the distal portion of the nail to apply varnish to the nail;

wherein the nib and the guide are attached to each other to form the assembly;

wherein at least a portion of the guide is configured to be placed in a groove of the nib.

2. The assembly of claim 1, wherein the assembly is configured to be removable from the nail pen.

3. The assembly of claim 1, wherein the assembly is cylindrical shaped.

4. The assembly of claim 1, wherein the guide is configured as a sleeve to be placed on an outside portion of the nib.

5. The assembly of claim 4, wherein the, nib has an upper portion with a larger diameter than a lower portion with a smaller diameter, and the guide is placed on the lower portion of the nib with the smaller diameter.

6. The assembly of claim 5, wherein the sleeve and the nib form a uniform surface.

7. The assembly of claim 1, wherein the guide is placed, in an absent portion of a cylindrical nib.

8. The assembly of claim 1, wherein the nib is made from a single fabricated piece of the absorbent material, the nib having a channel inside.

9. The assembly of claim 1, wherein the guide and the nib are coaxial.

10. The assembly of claim 1, wherein the guide and the nib are coaxial with the guide running along a central axis of the nib, the guide further extending outside of an end of the nib.

11. The assembly of claim 1, wherein the assembly is configured to be placed in a cavity at a bottom end of the nail pen.

12. The assembly of claim 11, wherein both the guide and the nib enter the cavity of the nail pen.

13. The assembly of claim 11, wherein only the nib enters the cavity of the nail pen.

14. The assembly of claim 1, wherein the nib has a step.

15. The assembly of claim 1, wherein the guide is not attached directly to the nail pen.

16. An assembly for a nail pen comprising:

a) a nib made from a material that is configured to allow for movement of varnish from inside of the nail pen to the nib, and from the nib to a surface of a nail;

b) a guide placed inside of the nib made from a material that is non-absorbent to the varnish, the guide extending below a surface of the nib that is configured to apply varnish to the nail;

wherein a user applies a strip of the vanish to a distal portion of the nail by holding the guide against an edge of the nail and moving the nail pen along the distal portion of the nail so that the surface of the nib holding the varnish contacts the distal portion of the nail to apply varnish to the nail;

wherein a portion of the guide extends out of an inside-bottom of the nib and is configured to contact a nail.

17. The assembly of claim 16, wherein the guide and the nib are coaxial.

18. The assembly of claim 16, wherein the guide is cylindrical.

19. An assembly for a nail pen comprising:

a) a nib made from a material that is configured to allow for movement of varnish from inside of the nail pen to the nib, and from the nib to a surface of a nail:

b) a guide made from a material that is non-absorbent to the varnish, the guide extending below a surface of the nib that is configured to apply varnish to the nail;

wherein a user applies a strip of the vanish to a distal portion of the nail by holding the guide against an edge of the nail and moving the nail pen along the distal portion of the nail so that the surface of the nib holding the varnish contacts the distal portion of the nail to apply varnish to the nail;

wherein the nib and the guide are attached to each other to form the assembly;

wherein the guide and the nib are coaxial.

* * * * *